US011164708B2

(12) United States Patent
So et al.

(10) Patent No.: US 11,164,708 B2
(45) Date of Patent: Nov. 2, 2021

(54) BACKLIT SWITCHES

(71) Applicant: Hewlett-Packard Development Company, L.P., Spring, TX (US)

(72) Inventors: Yu Chen So, Taipei (TW); Weiming Tseng, Taipei (TW); Chi-Chih Huang, Taipei (TW); Lien-Chia Chiu, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/982,212

(22) PCT Filed: Jun. 21, 2018

(86) PCT No.: PCT/US2018/038781
§ 371 (c)(1),
(2) Date: Sep. 18, 2020

(87) PCT Pub. No.: WO2019/245565
PCT Pub. Date: Dec. 26, 2019

(65) Prior Publication Data

US 2021/0125802 A1 Apr. 29, 2021

(51) Int. Cl.
*H01H 13/83* (2006.01)

(52) U.S. Cl.
CPC ..... *H01H 13/83* (2013.01); *H01H 2219/062* (2013.01); *H01H 2221/044* (2013.01)

(58) Field of Classification Search
CPC ..... H01H 13/83; H01H 2219/062; H01H 2221/044
USPC ..... 200/314
See application file for complete search history.

(56) References Cited

U.S. PATENT DOCUMENTS

| | | | | |
|---|---|---|---|---|
| 4,017,700 | A | 4/1977 | West | |
| 4,056,701 | A * | 11/1977 | Weber | H01H 13/83 200/314 |
| 5,990,772 | A | 11/1999 | Van Zeeland | |
| 6,800,819 | B2 | 10/2004 | Sato et al. | |
| 7,609,178 | B2 | 10/2009 | Son et al. | |
| 8,258,416 | B2 | 9/2012 | Sarrah et al. | |
| 2003/0160669 | A1 | 8/2003 | Trandafir | |
| 2007/0257821 | A1* | 11/2007 | Son | G06F 3/0446 341/22 |
| 2010/0172080 | A1 | 7/2010 | Bestle | |
| 2010/0328338 | A1 | 12/2010 | Kim et al. | |
| 2018/0358192 | A1* | 12/2018 | Kohn | H01H 13/83 |

FOREIGN PATENT DOCUMENTS

| | | | |
|---|---|---|---|
| KR | 20040004795 | A | 1/2004 |
| WO | WO-2017097977 | A1 | 6/2017 |

* cited by examiner

*Primary Examiner* — Edwin A. Leon
*Assistant Examiner* — Iman Malakooti
(74) *Attorney, Agent, or Firm* — HPI Patent Department

(57) ABSTRACT

Example of backlit switches are described. In an example, a backlit switch includes a printed circuit board (PCB) and a dome-type button coupled to the PCB. The dome-type button has a light transmitting portion. A light source is mounted on a first side of the PCB, and a tact switch is mounted on a second side of the PCB that is opposite to the first side. Further, a projection is provided to trigger the tact switch, in response to pressing of the dome-type button.

15 Claims, 6 Drawing Sheets

BACKLIT SWITCHES

BACKGROUND

Backlit switches may be used in devices, such as laptops, tablets, smartphones, and display monitors. A backlit switch may selectively transmit light to indicate between an ON state and an OFF state of the backlit switch.

BRIEF DESCRIPTION OF DRAWINGS

The following detailed description references the drawings, wherein.

DETAILED DESCRIPTION

Figure 1:
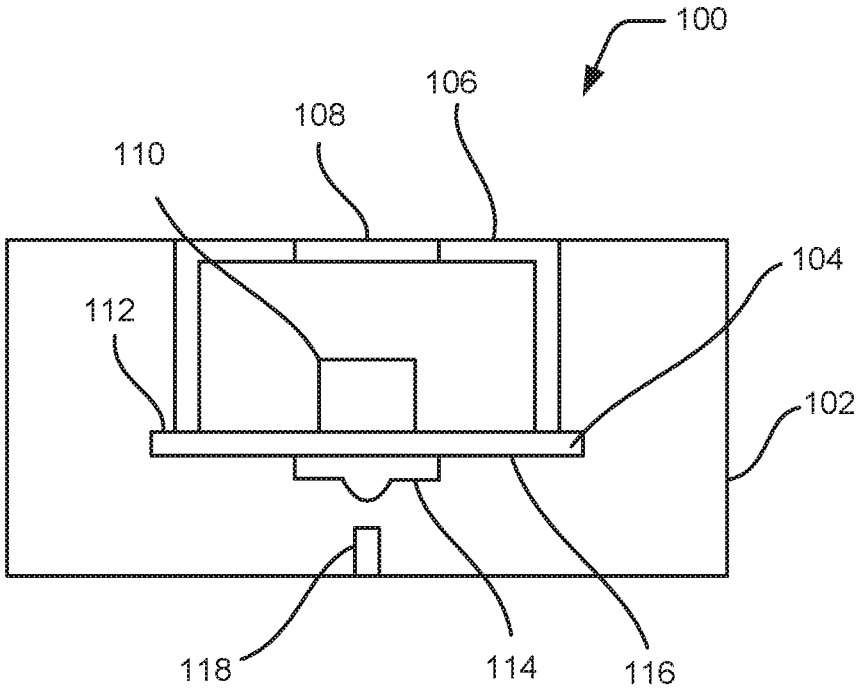
FIG. 1 illustrates a backlit switch, according to an example.

A backlit switch in a device may have a printed circuit board (PCB), and a tactile switch and a light source mounted on the PCB. The backlit switch may also have a button with a light transmitting portion and a plunger. When the button of the backlit switch is pressed by a user, the plunger triggers the tactile switch, also referred to as a tact switch, which may initiate an operation associated with the tact switch and may also switch ON or switch OFF the light source depending on the associated operation. In an example, a device may have a power ON/OFF switch as a backlit switch. With the device in a power OFF state, pressing of the button of the power ON/OFF switch switches ON the device and also switches ON the light source to transmit light through the light transmitting portion of the button. The light transmitting through the button of the power ON/OFF switch indicates a power ON state of the device.

In the backlit switch, the tact switch and the light source are mounted on the same side of the PCB. Either the tact switch or the light source is centered with respect to the button. In case the tact switch is centered and the light source is not, the uniformity of light transmitted through the light transmitting portion of the button is compromised. In case the light source is centered and the tact switch is not, the press feeling of the button to the user is compromised, which affects the user experience.

The present subject matter describes backlit switches and devices with backlit switches. With the backlit switches of the present subject matter, both the press feeling of the buttons of the backlit switches and the uniformity of light transmitted through the buttons of the backlit switches are good, and one is not compromised at the expense of the other.

In accordance with an example, a backlit switch includes a PCB and a dome-type button coupled to the PCB. The PCB may include electrical lines and components that facilitate triggering operations in response to pressing on the dome-type button of the backlit switch by a user. The dome-type button, also referred to as a button, may refer to a hollow shell coupled to the PCB, such that the pressing of the button moves the PCB along with the button. The button has a light transmitting portion through which light can transmit.

The backlit switch includes a light source mounted on a first side of the PCB and a tact switch mounted on a second side of the PCB. The first side of the PCB, on which the light source is mounted, faces the button and the second side is opposite to the first side. The light source is enclosed within the hollow space of the button. The tact switch may refer to a toggle switch. Further, a projection is provided on a housing of the backlit switch or on a chassis of the device, which can trigger the tact switch, in response to pressing of the button by a user. In operation, when the button of the backlit switch is pressed, the button and the PCB are moved in the direction of pressing. The movement of the PCB allows the projection to trigger the tact switch to selectively execute an operation associated with the tact switch and selectively operate the light source for transmitting light through the light transmitting portion of the button.

With the light source and the tact switch on the opposite sides of the PCB of the backlit switch, the press feeling of the button and the uniformity of light transmitted through the button are good. Neither the press feeling of the button nor the uniformity of light transmitted through the button of the backlit switch is compromised, which facilitates improving the user experience of the backlit switches.

The following detailed description refers to the accompanying drawings. Wherever possible, the same reference numbers are used in the drawings and the following description to refer to the same or similar parts. While several examples are described in the description, modifications, adaptations, and other implementations are possible. Accordingly, the following detailed description does not limit the disclosed examples. Instead, the proper scope of the disclosed examples may be defined by the appended claims.

FIG. 1 illustrates a backlit switch 100, according to an example. The backlit switch 100 may be implemented in a device, such as a laptop, a tablet, a smartphone, a display monitor, or the like. In an example, the backlit switch 100 may be a power ON/OFF switch of a device.

The backlit switch 100 includes a housing 102 and a PCB 104 disposed in the housing 102. The housing 102 may refer to an enclosure enclosing the components of the backlit switch 100. The PCB 104 may include electrical lines (not shown) and components (not shown) that enable triggering of operations in response to actuation of the backlit switch 100 by a user. In an example, the PCB 104 may also include electrical lines (not shown) and components (not shown) for functionalities or operations that are independent of actuation of the backlit switch 100.

The backlit switch 100, as shown in FIG. 1, includes a dome-type button 106. The dome-type button, hereinafter referred to as a button 106, is coupled to the PCB 104. In an example, the button 106 may be coupled to the PCB 104 by an adhesive. In an example, the PCB 104 may have slots and the button 106 may have projections that may fit in the slots to couple the button 106 to the PCB 104. The button 106 is opaque and includes a light transmitting portion 108 in an opaque region of the button 106. The light transmitting portion 108 may refer to a transparent or translucent portion of the button 106 that is illuminated by transmission of light through the light transmitting portion 108. The light transmitting portion 108 may depict a character, for example, an alphabet, a number, or a symbol. In an example, the button 106 may be made of a polymer, such as plastic.

The backlit switch 100 also includes a light source 110 mounted on a first side 112 of the PCB 104 that is facing the button 106. The light source 110 is placed on the first side 112 of the PCB 104, such that the light source 110 is enclosed within the button 106 to transmit light, emitted by the light source 110, through the light transmitting portion 108. In an example, the light source 110 may be a light emitting diode or the like. The light source 110 is electrically coupled to the PCB 104, such that the light source 110 can be switched ON or OFF through the electrical lines on the PCB 104.

Further, as shown in FIG. 1, the backlit switch 100 includes a tact switch 114 mounted on a second side 116 of the PCB 104 that is opposite to the first side 112 of the PCB 104. The tact switch 114 may be a toggle switch. The backlit switch 100 further includes a projection 118 on the housing 102 to trigger the tact switch 114, in response to pressing of the button 106 of the backlit switch 100.

With the button 106 being coupled to, or in contact with, the PCB 104, the pressing of the button 106 by a user moves the PCB 104 along with the button 106, which causes the projection 118 to come in contact with the tact switch 114, thereby triggering the tact switch 114. In an example, triggering of the tact switch 114 by the projection 118 on the housing 102 may execute an operation, such as switching ON of the device in which the backlit switch 100 is implemented and switching ON the light source 110 to transmit light through the light transmitting portion 108 and illuminate the button 106.

Figure 2:
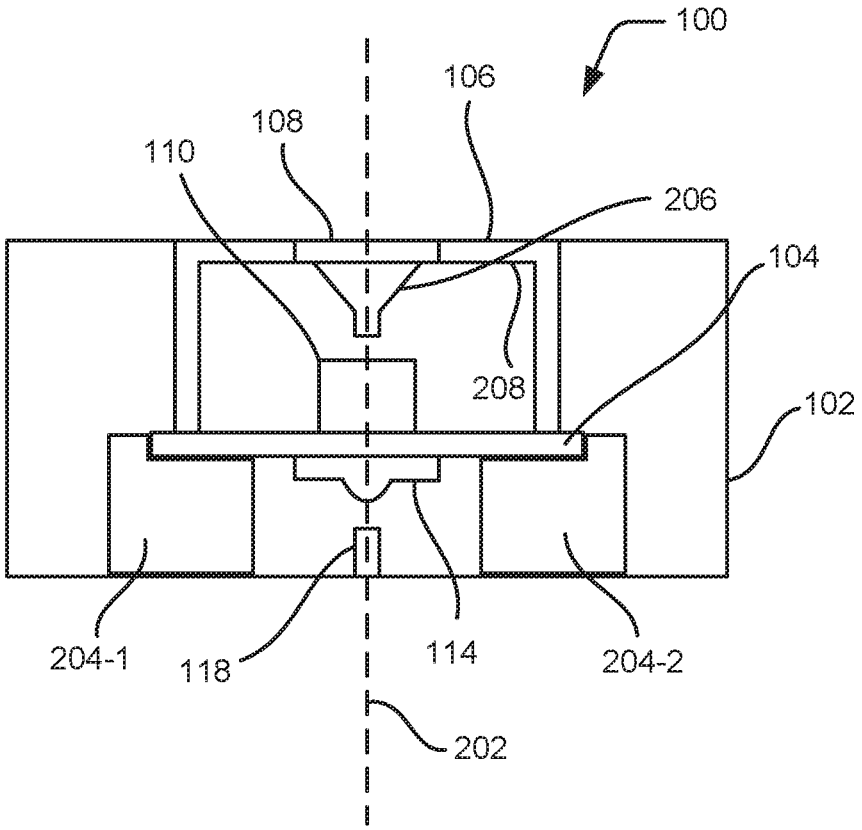
FIG. 2 illustrates an example of the backlit switch of FIG. 1.

FIG. 2 illustrates an example of the backlit switch 100 of FIG. 1. As shown in FIG. 2, the light source 110 and the tact switch 114 are mounted about a common axis 202 perpendicular to the first side 112 of the PCB 104. The common axis 202 is also perpendicular to the second side 116 of the PCB 104. In an example, the common axis 202 about which the light source 110 and the tact switch 114 are mounted, may be a central axis of the button 106. With the light source 110 and the tact switch 114 being mounted on the opposite sides of the PCB 104 about the common axis 202 central to the button 106, the press feeling of the button 106 to a user due to a feedback from triggering of the tact switch 114 is good and also the uniformity of light emitted by the light source 110 and transmitted through the light transmitting portion 108 of the button 106 is good.

Further, as shown in FIG. 2, the backlit switch 100 includes a padding 204-1 and 204-2 of a flexible material. The padding 204-1 and 204-2 may be a single piece padding or a multi-piece padding disposed in the housing 102. As shown in FIG. 2, the PCB 104 is rested on the padding 204-1 and 204-2 to move the PCB 104 and the button 106 together, in response to pressing the button 106, to contact the projection 118 with the tact switch 114. In an example, the padding 204-1 and 204-2 may be made of a material with elastic properties, such as rubber.

Further, as shown in FIG. 2, the button 106 of the backlit switch 100 includes a light guide 206. The light guide 206 is to guide light, emitted by the light source 110, through the light transmitting portion 108 of the button 106. The light guide 206 is on an inner surface 208 of the button 106 that faces the light source 110. In an example, the light guide 206 may be placed above the light source 110 and about the common axis 202, such that maximum amount of light that is emitted by the light source 110 is guided through the light guide 206 to illuminate the light transmitting portion 108 of the button 106. In an example, the light guide 206 is integrated with the button 106, and is made of the same material as that of the button 106.

Figure 3:
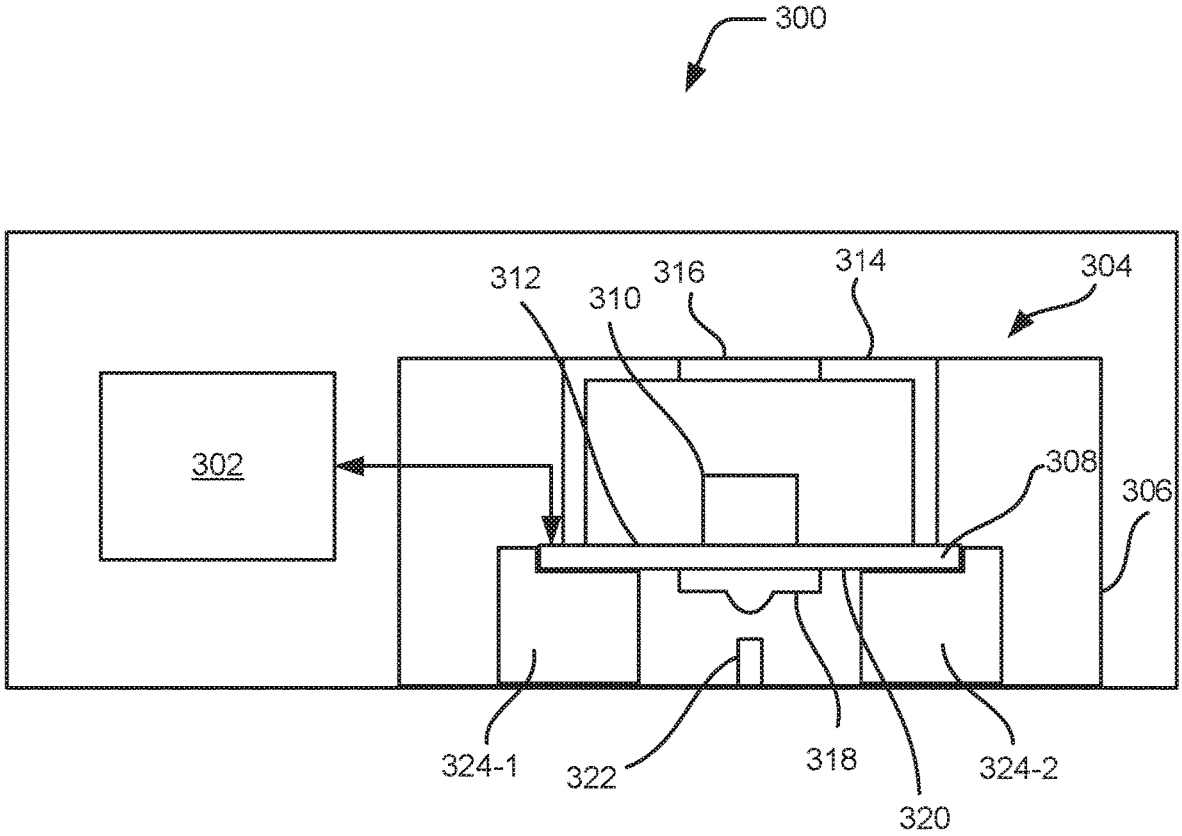
FIG. 3 illustrates a device comprising an electronic unit and a backlit switch, according to an example.

FIG. 3 illustrates a device 300 comprising an electronic unit 302 and a backlit switch 304, according to an example. In an example, the device 300 may be a laptop, a tablet, a smartphone, or the like. The electronic unit 302, when operated, may provide a functionality to the device 300. The backlit switch 304 may initiate or stop the operation of the electronic unit 302. In an example, the electronic unit 302 may be a motherboard of the device 300, and the backlit switch 304 may be an ON/OFF switch to power ON or power OFF the motherboard.

As shown in FIG. 3, the backlit switch 304 includes a housing 306 and a PCB 308 disposed in the housing 306. The housing 306 and the PCB 308 of the backlit switch 304 may be similar to the housing 102 and the PCB 104, respectively, of the backlit switch 100 described with reference to FIG. 1. The PCB 308 of the backlit switch 304 is electrically coupled to the electronic unit 302.

The backlit switch 304 includes a light source 310 mounted on a first side 312 of the PCB 308. In an example, the light source 310 may be a light emitting diode or the like. The backlit switch 304 also includes a dome-type button 314 coupled to the PCB 308. In an example, the dome-type button 314, hereinafter referred to as a button 314, may be coupled to the PCB 308 by an adhesive. As shown in FIG. 3, the button 314 encloses the light source 310. The button 314 is opaque and includes a light transmitting portion 316 in an opaque region of the button 314, similar to that in the button 106 of the backlit switch 100, to transmit light emitted by the light source 310. In an example, the button 314 may be made of a polymer, such as plastic. The light source 310 is electrically coupled to the PCB 308, such that the light source 310 can be switched ON or OFF through electrical lines on the PCB 308.

Further, the backlit switch 304 includes a tact switch 318 mounted on a second side 320 of the PCB 308 that is opposite to the first side 312 of the PCB 308. The tact switch 318 may be similar to the tact switch 114 of the backlit switch 100 as described with reference to FIG. 1.

The backlit switch 304 further includes a projection 322 on the housing 306 and a padding 324-1 and 324-2 of a flexible material disposed between the PCB 308 and the housing 306. The padding 324-1 and 324-2 may be a single piece padding or a multi-piece padding, made of a material with elastic properties, such as rubber. The padding 324-1 and 324-2 is to move the PCB 308 and the button 314 together and trigger the tact switch 318 by the projection 322, in response to pressing the button 314, to operate the electronic unit 302 and the light source 310. Triggering of the tact switch 318 by the projection 322 may switch ON or switch OFF the electronic unit 302 and the light source 310, as the case may be.

Figure 4:
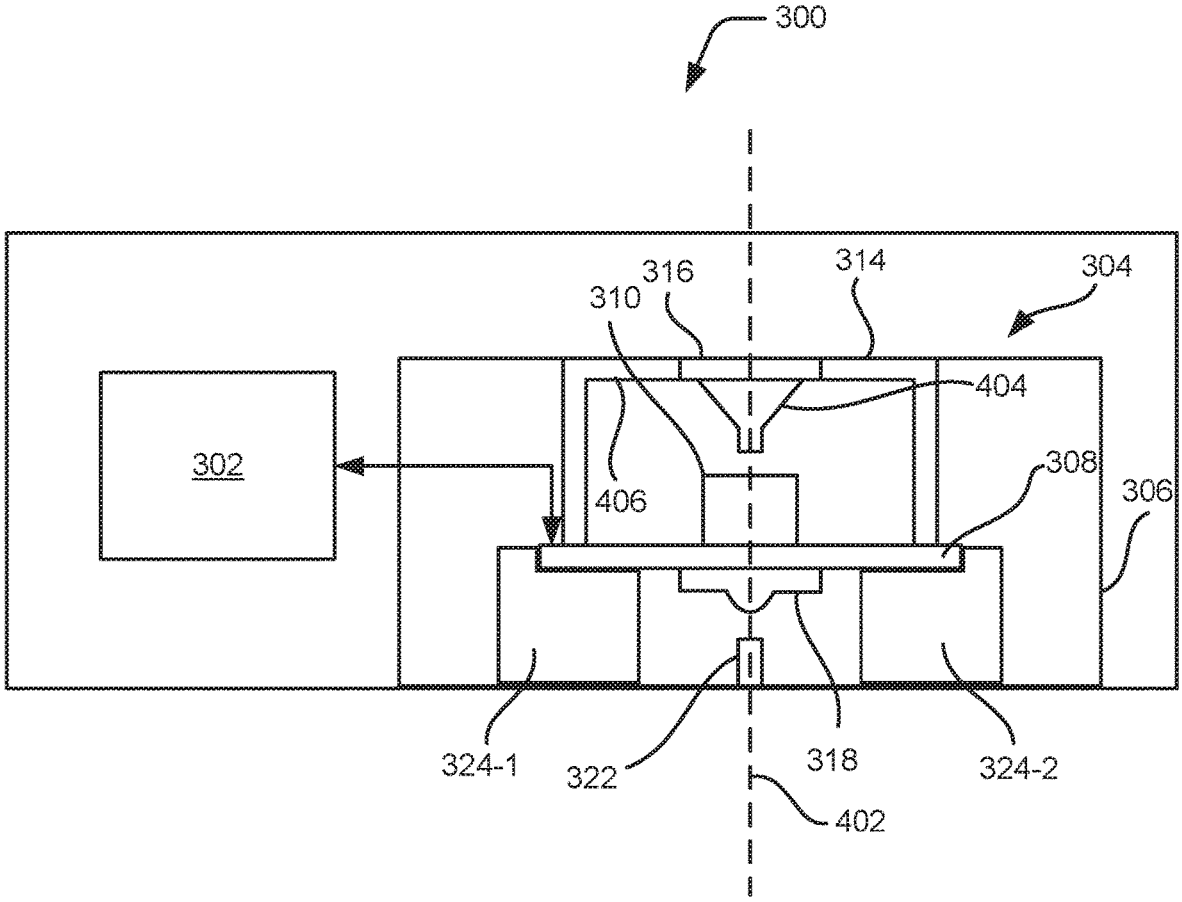
FIG. 4 illustrates an example of the backlit switch of the device of FIG. 3.

FIG. 4 illustrates an example of the backlit switch 304 of the device 300 of FIG. 3. As shown in FIG. 4, the light source 310 and the tact switch 318 are mounted about a common axis 402 perpendicular to the first side 312 of the PCB 308. The common axis 402 is also perpendicular to the second side 320 of the PCB 308. In an example, the common axis 402 may be a central axis of the button 314.

Further, as shown in FIG. 4, the button 314 of the backlit switch 304 includes a light guide 404. The light guide 404 is to guide light, emitted by the light source 310, through the light transmitting portion 316 of the button 314. The light guide 404 is integrated with the button 314. The light guide 404 is on an inner surface 406 of the button 314 that faces the light source 310. In an example, the light guide 404 may be placed above the light source 310 and about the common axis 402, such that maximum amount of light that is emitted by the light source 310 is guided through the light guide 404 to illuminate the light transmitting portion 316 of the button 314.

Figure 5:
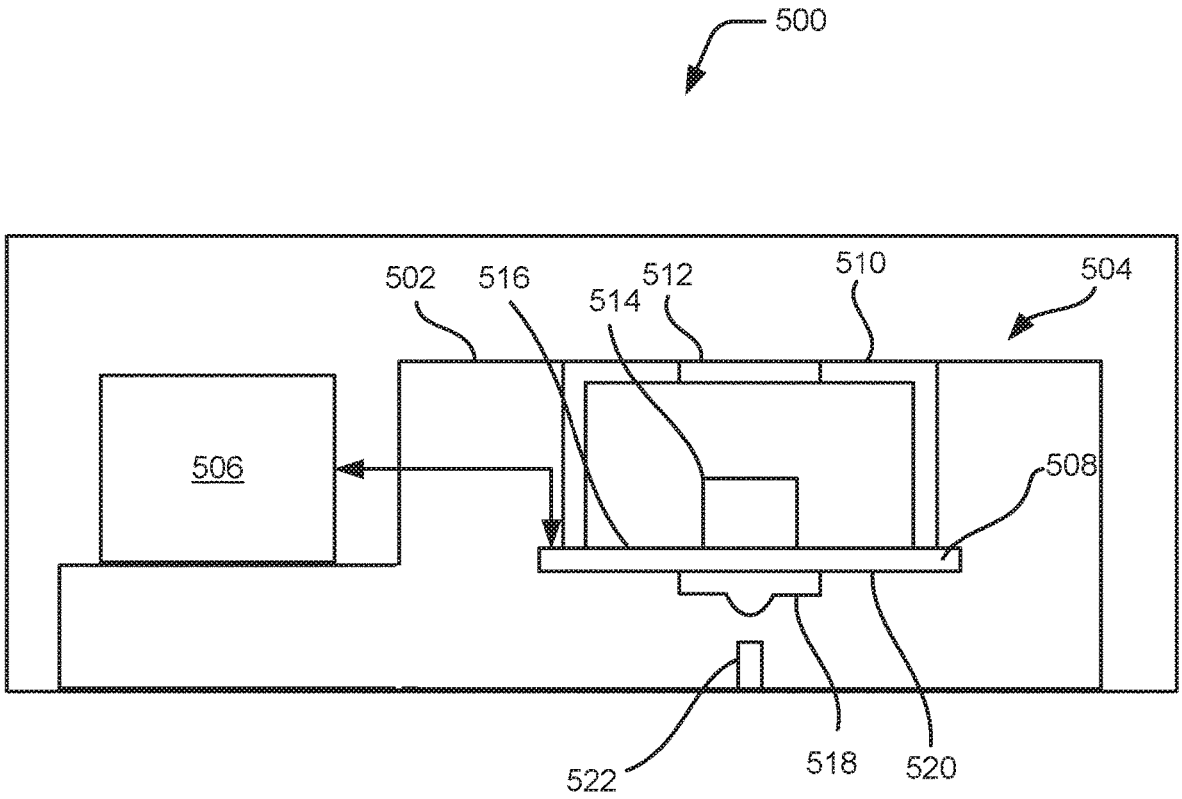
FIG. 5 illustrates a device comprising a chassis and a backlit switch, according to an example.

FIG. 5 illustrates a device 500 comprising a chassis 502 and a backlit switch 504, according to an example. In an example, the device 500 may be a laptop, a tablet, a smartphone, or the like. The chassis 502 may refer a frame of the device 500 on which various components of the device are mounted. The chassis 502 may be of a metallic material. The device 500 includes an electronic unit 506 mounted on the chassis 502. The electronic unit 506, when operated, may provide a functionality to the device 500. The backlit switch 504 may be mounted on the chassis 502 and may initiate or stop the operation of the electronic unit 506. In an example, the electronic unit 506 may be a motherboard of the device 500, and the backlit switch 504 may be an ON/OFF switch to power ON or power OFF the motherboard.

As shown in FIG. 5, the backlit switch 504 includes a PCB 508 electrically coupled to the electronic unit 506. The PCB 508 of the backlit switch 504 may be similar to PCB 104 of the backlit switch 100 described with reference to FIG. 1. The backlit switch 504 also includes a dome-type button 510 coupled to the PCB 508. In an example, the dome-type button, hereinafter referred to as a button 510, may be coupled to the PCB 508 by an adhesive. The button 510 is opaque and includes a light transmitting portion 512 in an opaque region of the button 510, similar to that in the button 106 of the backlit switch 100. In an example, the button 510 may be made of a polymer, such as plastic.

The backlit switch 504 includes a light source 514 mounted on a first side 516 of the PCB 508 that is facing the button 510. In an example, the light source 310 may be a light emitting diode or the like. The light source 514 is to emit light to transmit through the light transmitting portion 512 of the button 510. The light source 514 is electrically coupled to the PCB 508, such that the light source 514 can be switched ON or OFF through electrical lines on the PCB 508.

Further, the backlit switch 504 includes a tact switch 518 mounted on a second side 520 of the PCB 508 that is opposite to the first side 516 of the PCB 508. The tact switch 518 may be similar to the tact switch 114 of the backlit switch 100 as described with reference to FIG. 1. Further, as shown in FIG. 5, the device 500 includes a projection 522 on the chassis 502 to trigger the tact switch 518, in response to pressing the button 510, to operate the electronic unit 506 and the light source 514. Triggering of the tact switch 518 by the projection 522 may switch ON or switch OFF the electronic unit 506 and the light source 514, as the case may be.

Figure 6:
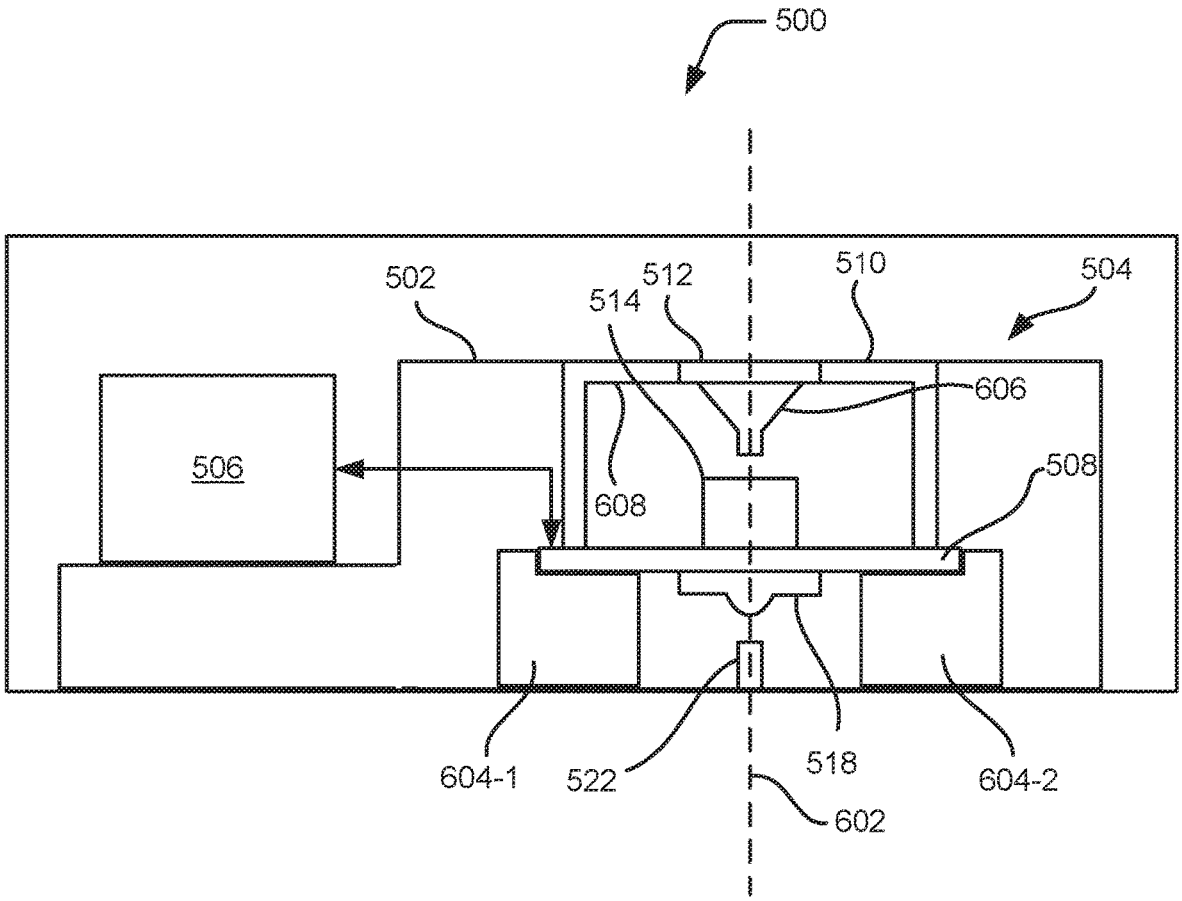
FIG. 6 illustrates an example of the backlit switch of the device of FIG. 5.

FIG. 6 illustrates an example of the backlit switch 504 of the device 500 of FIG. 5. As shown in FIG. 6, the light source 514 and the tact switch 518 are mounted about a common axis 602 perpendicular to the first side 516 of the PCB 508. The common axis 602 is also perpendicular to the second side 520 of the PCB 508. In an example, the common axis 602 is a central axis of the button 510.

Further, as shown in FIG. 6, the backlit switch 504 includes a padding 604-1 and 604-2 of a flexible material. The padding 604-1 and 604-2 may be a single piece padding or a multi-piece padding disposed on the chassis 502. As shown in FIG. 6, the PCB 508 is rested on the padding 604-1 and 604-2 to move the PCB 508 and the button 510 together, in response to pressing the button 510, to contact the projection 522 with the tact switch 518. In an example, the padding 604-1 and 604-2 may be made of a material with elastic properties, such as rubber.

Further, as shown in FIG. 6, the button 510 of the backlit switch 504 includes a light guide 606 disposed on an inner surface 608 thereof. The light guide 606 is to guide light, emitted by the light source 514, through the light transmitting portion 512 of the button 510. The light guide 606 is integrated with the button 510. In an example, the light guide 606 may be placed above the light source 514 and about the common axis 602, such that maximum amount of light that is emitted by the light source 514 is guided through the light guide 606 to illuminate the light transmitting portion 512 of the button 510.

Although examples for the present disclosure have been described in language specific to structural features, it is to be understood that the appended claims are not limited to the specific features described herein. Rather, the specific features are disclosed and explained as examples of the present disclosure.

We claim:

1. A backlit switch comprising:
- a housing;
- a printed circuit board (PCB) disposed in the housing;
- a dome-type button coupled to the PCB, the dome-type button comprising a light transmitting portion;
- a light source mounted on a first side of the PCB that is facing the dome-type button, the light source being enclosed within the dome-type button to transmit light, emitted by the light source, through the light transmitting portion;
- a tact switch mounted in direct contact with a second side of the PCB that is opposite to the first side; and
- a projection on the housing to trigger the tact switch, in response to pressing of the dome-type button.

2. The backlit switch as claimed in claim 1, comprising a padding of a flexible material, the PCB being rested on the padding to move the PCB and the dome-type button, in response to pressing of the dome-type button, to contact the projection with the tact switch.

3. The backlit switch as claimed in claim 1, wherein the dome-type button is coupled to the PCB by an adhesive.

4. The backlit switch as claimed in claim 1, wherein the light source and the tact switch are mounted about a common axis perpendicular to the first side of the PCB.

5. The backlit switch as claimed in claim 4, wherein the common axis is a central axis of the dome-type button.

6. The backlit switch as claimed in claim 1, wherein the dome-type button comprises a light guide to guide the light, emitted by the light source, through the light transmitting portion.

7. A device comprising:
- an electronic unit; and
- a backlit switch comprising:
  - a housing;
  - a printed circuit board (PCB) disposed in the housing, the PCB being electrically coupled to the electronic unit;
  - a light source mounted on a first side of the PCB;
  - a dome-type button coupled to the PCB, the dome-type button enclosing the light source and having a light transmitting portion to transmit light emitted by the light source;
  - a tact switch mounted in direct contact with a second side of the PCB that is opposite to the first side of the PCB;
  - a projection on the housing; and
  - a padding of a flexible material disposed between the PCB and the housing to move the PCB and the dome-type button and trigger the tact switch by the projection, in response to pressing of the dome-type button, to operate the electronic unit and the light source.

8. The device as claimed in claim 7, wherein the dome-type button is coupled to the PCB by an adhesive.

9. The device as claimed in claim 7, wherein the light source and the tact switch are mounted about a common axis perpendicular to the first side of the PCB.

10. The device as claimed in claim 9, wherein the common axis is a central axis of the dome-type button.

11. The device as claimed in claim 7, wherein the dome-type button comprises a light guide to guide the light, emitted by the light source, through the light transmitting portion.

12. A device comprising:

a chassis;

an electronic unit mounted on the chassis;

a backlit switch comprising:

a printed circuit board (PCB) electrically coupled to the electronic unit;

a dome-type button coupled to the PCB, the dome-type button having a light transmitting portion;

a light source mounted on a first side of the PCB that is facing the dome-type button, the light source is to emit light to transmit through the light transmitting portion; and a tact switch mounted in direct contact with a second side of the PCB that is opposite to the first side of the PCB; and a projection on the chassis to trigger the tact switch, in response to pressing of the dome-type button, to operate the electronic unit and the light source.

13. The device as claimed in claim 12, wherein the backlit switch comprises a padding of a flexible material, the PCB being rested on the padding to move the PCB and the dome-type button, in response to pressing of the dome-type button, to contact the projection with the tact switch.

14. The device as claimed in claim 12, wherein the light source and the tact switch are mounted about a common axis perpendicular to the first side of the PCB, the common axis being a central axis of the dome-type button.

15. The device as claimed in claim 12, wherein the dome-type button comprises a light guide disposed on an inner surface thereof, the light guide is to guide the light, emitted by the light source, through the light transmitting portion.

* * * * *